United States Patent [19]

Nagatsuma

[11] 4,316,374

[45] Feb. 23, 1982

[54] METHOD OF MANUFACTURING SEAMLESS WHEEL RIMS

[75] Inventor: Nobuyoshi Nagatsuma, Kawagoe, Japan

[73] Assignee: Honda Giken Kogyo Kabushiki Kaisha, Tokyo, Japan

[21] Appl. No.: 191,249

[22] Filed: Sep. 26, 1980

Related U.S. Application Data

[63] Continuation-in-part of Ser. No. 955,992, Oct. 30, 1978, abandoned.

[30] Foreign Application Priority Data

Oct. 31, 1977 [JP] Japan ..... 52/130523
Oct. 31, 1977 [JP] Japan ..... 52/130524
Oct. 31, 1977 [JP] Japan ..... 52/130525

[51] Int. Cl.[3] ..... B21H 1/10
[52] U.S. Cl. ..... 72/91; 72/105
[58] Field of Search ..... 72/91, 102, 105, 106, 72/107, 109; 113/116 D; 29/159.1, 159 R

[56] References Cited

U.S. PATENT DOCUMENTS 1,965,446 7/1934 Bell ..... 72/109
3,382,693 5/1968 Rozhdestvensky ..... 72/91
3,388,576 6/1968 Ernestus ..... 72/91
3,498,095 3/1970 Marcovitch ..... 72/91
4,067,217 1/1978 Bisaillon et al. ..... 72/91

FOREIGN PATENT DOCUMENTS 590667 1/1960 Canada ..... 29/159.1
2847844 5/1979 Fed. Rep. of Germany ..... 72/91
441237 10/1948 Italy ..... 72/91
51-42065 4/1976 Japan ..... 29/159.1
623618 7/1978 U.S.S.R. ..... 72/105

*Primary Examiner*—Lowell A. Larson
*Attorney, Agent, or Firm*—Irving M. Weiner; John L. Shortley; Pamela S. Burt

[57] ABSTRACT

A method of manufacturing seamless wheel rims while maintaining a predetermined outside diameter dimension and predetermined cross-sectional shape of the rims at a high precision, without requiring any correcting work. A ring-shaped material is interposed between a rotatable die having a surface corresponding to an outer peripheral shape of a wheel rim and a rotatable pressing roll provided within the die, either of the die or roll is driven to rotate, and the pressing roll is moved toward the die so as to roll and shape the material, while restraining the outside diameter dimension by the die.

4 Claims, 14 Drawing Figures

METHOD OF MANUFACTURING SEAMLESS WHEEL RIMS

This is a continuation-in-part of application Ser. No. 955,992, filed Oct. 30, 1978, now abandoned.

BACKGROUND OF THE INVENTION

1. Field of the Invention

The present invention relates generally to a method of shaping entirely seamless wheel rims made of, for example, an aluminum alloy, with high precision.

2. Description of Relevant Art

Methods of manufacturing seamless rims made of, for example, an aluminum alloy (which will be referred to hereinafter as an Al alloy) for vehicles such as automobiles and motorcycles are already disclosed in Jpananese Patent Laid-Open Nos. 43868/1974 and 42065/1976.

In such methods of manufacturing seamless Al alloy rims, a ring-shaped material is held between a pair of rolls opposed to each other, and one roll is moved toward the other roll so as to gradually reduce the distance between them. The rolls are rotated at the same time so as to roll and shape the material to be of a predetermined cross-section and to be enlarged in diameter. The enlargement of the diameter at the time of shaping the material is restrained by guide rolls arranged on the periphery of the material to be shaped.

The conventional methods of making seamless rims have the following attendant problems.

As the ring-shaped material is rolled and shaped between the rolls, the plastic deformation of the material is so predominantly large in the enlargement direction of the diameter that the diameter exceeds the predetermined dimension while the cross-sectional shape of the rim is not yet completed. Therefore, it is necessary to adjust the rolling so that the diameter may be made to be the predetermined dimension, simultaneously with the completion of the cross-sectional shape of the rim. However, such adjustment is so difficult, and further, because the other periphery restraining guide rolls provided in addition to the rolling rolls are so provided on the periphery only partially, the precision of the outside diameter dimension and circularity is difficult to obtain. Further, a twist or the like occurs. Therefore, after the rim is shaped, further correction work is required, and such work is so difficult and complicated that the number of steps in addition to the essential shaping step are necessarily increased. Also, such work requires excessive equipment and labor. Thus, the conventional methods are not desirable for mass-production and cost reduction of seamless rims. Also, during the correcting step, the obtained rim is likely to have a partial load or elongation and to be reduced in strength.

It may be considered to increase the number of the guide rolls to solve the problems associated with the conventional means. However, even if they are increased, the fundamental solution of the foregoing problems will not be obtained, the structure of the shaping apparatus will only be further complicated, and any effect will be minimal.

In view of the foregoing problems in the conventional methods of manufacturing seamless wheel rims, the present invention has been provided to effectively and fundamentally solve such problems and to obtain a highly effective method of manufacturing seamless wheel rims.

SUMMARY OF THE INVENTION

The present invention provides a method for manufacturing seamless wheel rims which includes the steps of: interposing a ring-shaped material between a rotatable die having a surface corresponding to an outside diameter dimension and an outer peripheral shape of a rim to be formed and a rotatable pressing roll provided within the die and having an outer surface corresponding to an inner peripheral shape of the rim; driving either the die or pressing roll to rotate; and rolling and shaping the material while restraining the outside diameter dimension thereof with the die. The pressing roll is moved toward the die to roll and shape the material between the die and roll into a predetermined cross-sectional shape, while the deformation toward the diameter enlarging direction as well as the outer peripheral shape of the material is restrained with the die. During such roll-shaping, substantial metal flow of the enlarged material occurs between the die and the roll. While both side ends of the shaped material are formed, excess material portions are formed to protrude sidewardly from reduced clearances defined for throttling the metal flow between the die and the roll on both sides in the width direction. A projection is formed on the inner periphery of the enlarged material, the thickness of the projection in the radial direction being substantially thicker than that of the initial material, while the metal flow in the width direction of the enlarged material is restrained by the reduced clearances.

An object of the present invention is therefore to provide a method of manufacturing seamless wheel rims, wherein the outside diameter dimension, cross-sectional shape and circularity of an obtained blank can be maintained at a high precision with only a single rolling step.

Another object of the present invention is to provide a highly effective method wherein steps of correcting the outside diameter, cross-sectional shape, circularity and twist after the shaping are completely eliminated, so that the obtained blank may be used immediately as a final product.

A further object of the invention is to obtain a highly effective and useful new method wherein the steps, equipment and apparatus required for making seamless rims can be reduced, thereby making manufacture simple and easy, facilitating mass production, and minimizing cost, while the quality of the seamless rims is improved and various problems associated with the conventional method are all fundamentally solved.

Yet a further object of the invention is to provide a method for manufacturing seamless wheel rims whereby a ring-shaped initial material is roll-shaped to obtain a final product having a thickness partially thicker than that of the initial material, such partially thicker portion of the final product comprising a radially-extending projection.

Further, the present invention provides a method wherein the volume of the ring-shaped material is set to be sufficiently larger than a predetermined volume of the final product. The excess material, when the shaping is completed, is protruded sidewise out of a space between the die and roll to purposefully shape excess material portions at both side ends so that a seamless rim which is not influenced by the nonuniformity of the volume of the material and is provided with a predetermined cross-section at a high precision may be simply obtained.

Furthermore, the present invention provides a method wherein a deep groove is formed in the center of a recess of the pressing roll, which corresponds to the inner peripheral shape of the rim. When the material is rolled and shaped while the plastic deformation in the width direction is restrained with the recess, the central part in the width direction of the material is projected toward the inner periphery so that a seamless rim provided with a projection ring in the center in the width direction of the inner periphery may be shaped while a high precision is maintained, the thickness of such projection ring in the radial direction being substantially greater than that of the initial material.

The seamless rim obtained in accordance with the present invention is particularly adapted for a tubeless wheel for motorcycles by utilizing the projection ring as a base for attaching spokes or spoke plates thereto.

The present invention is described in detail hereinbelow with reference to the accompanying drawings which illustrate preferred embodiments of the invention.

DETAILED DESCRIPTION OF PREFERRED EMBODIMENTS

Figure 2:
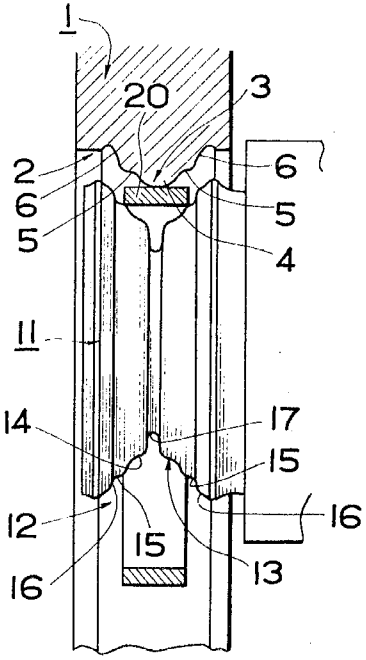
FIG. 2 is an enlarged sectioned view taken along line 2—2 in FIG. 1, showing the material after shaping.
Figure 1:
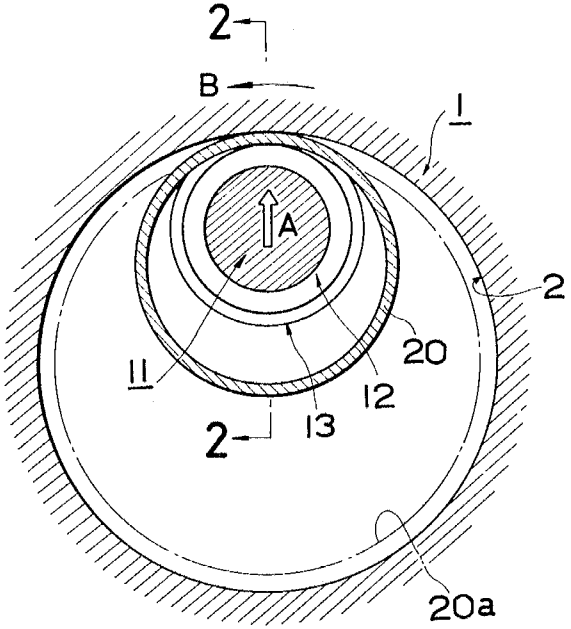
FIG. 1 is a vertical sectional view in the radial direction of a die and a pressing roll according to the invention, showing the material before shaping.

Referring to FIGS. 1 and 2, die 1 is provided with circular impression 3 on its inner periphery 2. The true circular impression 3 is so formed as to correspond to an outer peripheral shape and outside diameter dimension of the final product of a rim.

As clearly shown in FIG. 2, a ridge 4 for shaping a recessed part of the rim is provided in the center in the width direction. Substantially flat surfaces 5 for shaping bead receiving parts are provided on both sides of ridge 4. Walls 6 for shaping ear parts on both sides are provided as raised radially outwardly from respective outer sides of flat surfaces 5. The respective parts 4, 5, and 6 are provided in constant dimensions and cross-sectional shapes over the entire inside periphery of the impression 3.

A rotatable pressing roll 11 is arranged within the inner periphery 2 of die 1. Its rotary axis is parallel with the rotary center line of die 1 and is so formed as to be movable toward the inner periphery of die 1 as indicated by arrow A. A female impression 13, opposite impression 3, is provided on the outer periphery 12, opposite to the inner periphery 2 of die 1, of pressing roll 11.

Impression 13 is so formed as to fit the inner peripheral side of the cross-sectional shape of the rim to be obtained.

A recess 14 corresponding to projection 4 is provided in the center in the width direction. Substantially flat surfaces 15 corresponding to flat surfaces 5 are provided on both sides of recess 14. Rising walls 16 are provided on respective outer side ends of flat surfaces 15. Further, in this embodiment, a deep narrow concave groove 17 is provided in the center in the width direction of recess 14. The respective parts 14, 15, 16 and 17 are provided over the entire outer periphery of roll 11 in constant dimensions and cross-sectional shapes.

A thick ring-shaped material 20 made of an Al alloy is inserted between pressing roll 11 and die 1, and is so set as to be partially supported by a part between flat surfaces 15 of impression 13 of pressing roll 11. The state just before shaping, i.e., at the time when the material 20 has been set and pressing roll 11 has been moved toward the die 1, is shown in FIGS. 1 and 2.

The material 20, which is considerably thick and ring-shaped, taking its plastic deformation into consideration, is of a diameter smaller than die 1 but sufficiently larger than pressing roll 11 and is shaped of an Al alloy. The ring-shaped material 20 may be obtained by forging or by cutting a cylindrical material drawn or extruded into a predetermined width by any suitable means. In either case, the material is already seamless and continuously ring-shaped.

Figure 3:
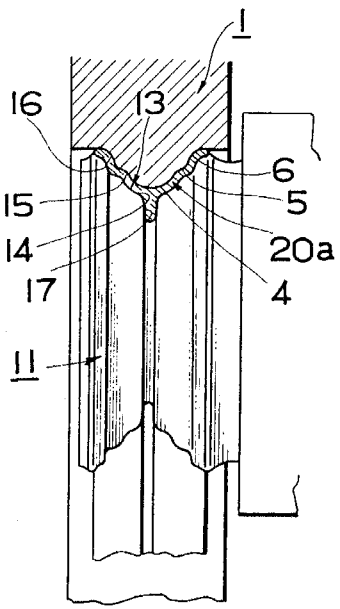
FIG. 3 is a view in the same direction as FIG. 2, showing the material after shaping.

After the material 20 is inserted and set as described above, die 1 is driven to rotate counterclockwise as indicated by an arrow B, from the state shown in FIGS. 1 and 2. Thereby, the rotatably supported pressing roll 11, contacting die 1 through the material 20, rotates counterclockwise so that the material 20 between die 1 and pressing roll 11 may be fed in the same direction. Pressing roll 11 is then moved toward the inner periphery of die 1 as indicated by arrow A in FIG. 1, so that the distance between the impressions 3 and 13 may be gradually reduced. Thereby, the material 20 is gradually rolled and shaped to be of a predetermined cross-sectional shape between the impressions 3 and 13. At the same time, the material 20 is enlarged in diameter by a rolled plastic deformation between the impressions 3 and 13. During roll-shaping, the enlarging deformation rate of the diameter is very high with substantial metal flow of the enlarged material occurring between die 1 and roll 11, and the enlarging deformation of the diameter is regulated and restrained by the inner periphery of rotated die 1. Because the inner periphery 2 is formed to be of the final outside diameter dimension of the material 20 as above described, the enlarging deformation of the outside diameter of the rim with the rolled plastic deformation is stopped and held at the final outside diameter dimension. Therefore, as shown in FIG. 3, the material 20*a* shaped to be of the cross-sectional shape of the final product, is shaped into the predetermined final outside diameter dimension as indicated by the phantom line in FIG. 1.

The ring-shaped material is thus rolled and shaped into the predetermined cross-sectional shape and the outside diameter dimension of the final product by die 1 and pressing roll 11. Because the described shaping is made while the outside diameter is restrained, adjustment of the cross-sectional shape and the outside diameter of the rim at the time of shaping is not at all required.

The thus obtained shaped product 20*a* has the required predetermined cross-section; is maintained at high precision in the outside diameter dimension; is high in circularity; and has no twist. Therefore, the step of correcting the outside diameter dimension and circularity is completed eliminated.

The reasons for rotating and driving die 1 while the pressing roll 11 is made freely rotatable and radially movable are described below.

If the die 1 and pressing roll 11 are made to be respectively driven, a relative velocity deviation will be produced in the rolling process between the die 1 and roll 11. In such case, it will be necessary to control the rotating velocities of both die 1 and roll 11 so as to be perfectly synchronized with each other. However, in fact, such control is very difficult. Particularly, if the die and roll have different diameters, it will be very difficult to obtain a driving mechanism ensuring synchronized rotations of both. Further, if a rotating velocity difference occurs between the die and roll, a slip will be produced in the rolling part, the material will be peeled to be rough on the surface thereof, and a perfect product will not be obtained.

In the interaction between the die 1 and pressing roll 11, if the die 1 is made freely rotatable and radially movable while the pressing roll 11 is driven, in the initial period of starting, a frictional force of the roll 11 on the die 1 will be generated through the material. In such case, if the material is easily deformable (such as an Al alloy), has only minimal contact surface, and is to be formed into a large diameter rim such as for a motorcycle, the die will be required to be so large and heavy that, with a roll of a small diameter, the rolling work will have to be performed by a considerably high pressure driving force. As a result, a slip will be produced between the die and roll, and the material will be rubbed to be rough on the surface thereof. Further, the mechanism will be complicated and the roll will be loaded to such an extent as to transmit the rotating driving force to the large and heavy die.

Therefore, it is desirable to have the die 1 on the driving side and the roll 11 on the driven side.

Figure 5:
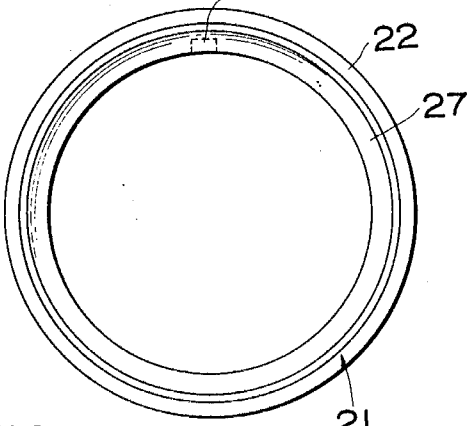
FIG. 5 is an elevational view of the rim.
Figure 6:
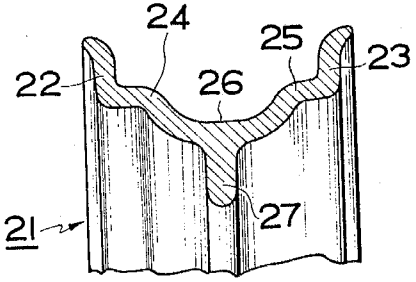
FIG. 6 is a sectional view of the rim, showing an essential part of FIG. 4 as enlarged.
Figure 4:
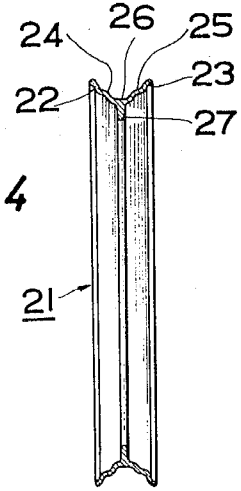
FIG. 4 is a vertical sectional view of the obtained rim.

The obtained seamless rim 21 is shown in FIG. 4 and is shown as enlarged in FIG. 6. The rim 21 is provided with ear pieces 22 and 23 rising on both sides and protruding outwardly substantially beyond the width of the initial blank, with bead receiving parts 24 and 25 inside ear pieces 22 and 23, and with a recessed or dropping part 26 lowered by one step in the center. In this embodiment, a radially inward projection 27 is formed in the center in the width direction of dropping part 26 by the concave groove 17 of impression 13 of roll 11, the groove 17 being sufficiently deep such that the thickness of projection 27 in the radial direction is formed to be substantially greater than the thickness of the initial material 20. FIG. 4 shows an entire vertical section of the thus obtained seamless rim. FIG. 5 shows a side view of rim 21, wherein reference numeral 28 indicates a notch provided on the projection 27 for an air valve fitting part required when the rim is used for a tubeless wheel. The notch can be easily obtained by cutting off a part of projection 27.

In one working example of the invention, a ring-shaped material of JIS (Japanese Industrial Standard) A5056 aluminum alloy, which is work-hardenable, having a 330 mm outside diameter, a 13 mm thickness, and a width of 80 $mm^2$ in sectional area was set between the die and the pressing roll. The material was then rolled from the state shown in FIGS. 2 and 3 at a peripheral speed of 90 mm/min and a draft speed of 1–0.1 m/sec until the outside diameter of the material was expanded over the entire inner periphery of the die. As a result, there was obtained a product as shown in FIG. 6, having an outside diameter of 490 mm, a width of 850 mm, a height of 50 mm at the most thickened portion (viz., at projection 27), and an average thickness of 5 mm. The product was a true circle having a favorable metallic glitter without being ground. The tensile strength was 35 $kg/cm^2$ at a rolling reduction of 75%, and the extension was 14%, i.e., the product had sufficient mechanical strength for use as a wheel rim for motorcycles and the like.

Figure 13:
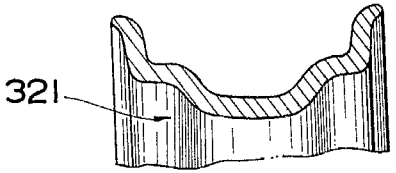
FIG. 13 is the same view as FIG. 10, showing a modified embodiment of a rim.

The manufacture of the rim provided with projection 27 in the form of a ring over the entire inner periphery has been explained hereinabove. However, as shown in FIG. 13, a rim 321 provided with an ordinary cross-sectioned shape having no projection can also be obtained. Further, if the cross-sectional shapes of the impressions 3 and 13 of the die 1 and roll 11 are modified, a rim of any desired cross-sectional shape can be obtained.

In shaping the rim, a plastic deformation toward the diameter enlarging direction at the time of shaping is so predominantly large that, if the volume of the material 20 is nonuniform, such nonuniformity will be likely to generate a nonuniformity of the diameter of the rim when the shaping is completed. In such case, a correcting step will be required. Particularly, if the volume is small, a predetermined cross-section will be difficult to obtain at high precision, and shaping flaws such as reduced thickness will occur. Therefore, it is necessary to strictly control the cross-section and volume of the material. However, it is difficult to provide such control.

Figure 7:
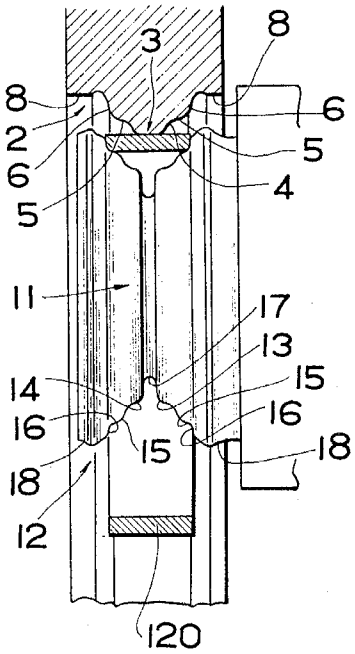
FIG. 7 is the same view as FIG. 2, of a modified embodiment.
Figure 8:
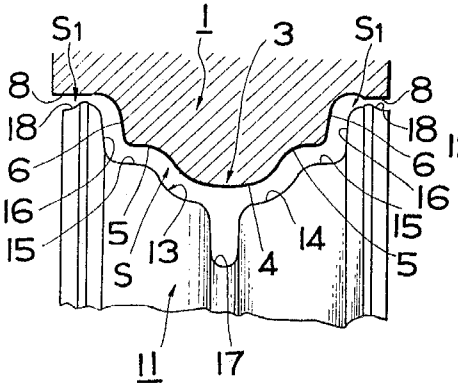
FIG. 8 is an enlarged sectioned view of the die and the pressing roll at the time when the shaping is completed but the material is removed.

In view of such problem, as shown in FIG. 7, the volume of the material 20 is so set as to be sufficiently larger than the predetermined volume at the time when the shaping into the predetermined cross-sectional shape is complete. In other words, the cross-sectional area of the material 20 shown in FIG. 7 is set to be larger than as shown in FIG. 2. The die 1 and roll 11 are provided with guide edges 8 and 18 on both sides so as to form reduced escaping or throttling clearances $S_1$ on both sides of a space S (FIG. 8) enclosed with the impressions 3 and 13 when the die 1 and pressing roll 11 are finally closed, that is, when the distance between them when the shaping is complete is the smallest, as shown in FIG. 8.

Figure 10:
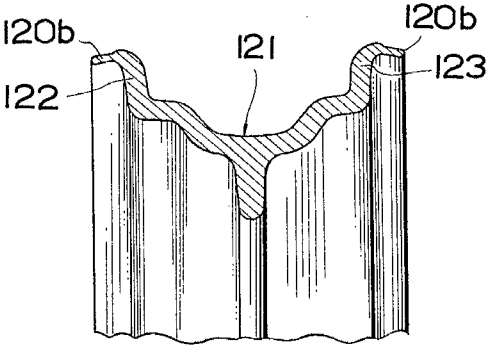
FIG. 10 is an enlarged sectional view of the product.
Figure 9:
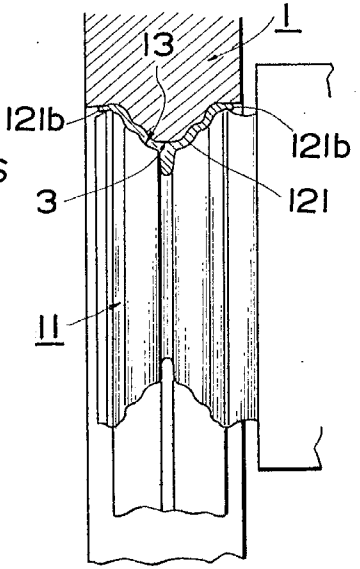
FIG. 9 is the same view as FIG. 7 at the time when the material shaping is completed.

In order to from the ear parts 122, 123 on both axial sides of the wheel rim without defects and without a time lag between formation of the two ear parts, and because the volume of material exceeds the cross-sectional volume after shaping is complete, excess material portions are formed on both sides of the shaped blank through the clearances $S_1$ on both sides of space S between impressions 3 and 13, as shown in FIG. 9. Thus, while the ear parts are being formed, the clearances $S_1$ serve a throttling function and provide effective resistance to the metal flow between die 1 and roll 11 on both sides in the width direction. This protruded excess material 120*b* on both sides is connected with the shaped material. The completely shaped material 121 having the excess material 120*b* is taken out and material 120*b* is cut from the ear parts 122 and 123 in the state shown in FIG. 10, to obtain the seamless Al alloy rim as described above.

Thus, a seamless Al alloy rim, having no attendant shaping flaws such as a reduced thickness, and having a highly precisely maintained cross-sectional shape and outside diameter dimension can be obtained without being influenced by the uniformity of the volume of the material.

Further, in one embodiment of the invention, the rim 21 having projection 27 in the center of the inner periphery is shaped. Projection 27 is used as a base for attaching spokes or spoke plates which connect a motorcycle rim and hub with each other. When projection 27 is used as a fitting base, it will not be necessary to make holes for attaching spokes or the like in the dropping part 26 of rim 21. Therefore, such rim can be used as a rim for tubeless tires of motorcycles or the like, and can be obtained without adopting a cast wheel.

In conventional means, such rim having the projection 27 in the inner periphery and being seamless has been so difficult to obtain that there has been employed a bar-shaped material having a projection on the lower side which must be wound with a roll to be shaped in the form of a cut circular ring, and must be butted and welded in the end parts. Thus, many steps are required and the obtained rim must be corrected and finished subsequently, and is inferior with respect to strength and rigidity.

In contradistinction, with the present invention, by setting the shape of the roll 11 as described above, a very high quality rim having projection 27 in the inner periphery can be easily obtained.

It is required that the projection be thick enough to be used as a base for attaching spokes or spoke plates, and be projected toward the axle as required. Therefore, at the time of shaping, the material must be made to permit plastic flow sufficiently outwardly in the width direction and radial direction and to flow sufficiently into concave groove 17 of roll 11 located inwardly in the radial direction. Even if the material is interposed between the impressions 3 and 13, such operation alone is insufficient for shaping of the projection 27.

Figure 11:
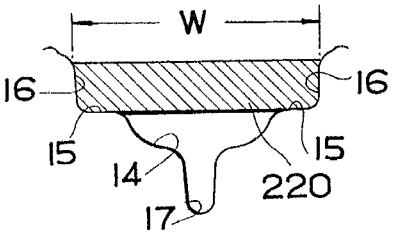
FIG. 11 is a sectional view for explaining the relation between the roll and material, of a further modified embodiment.

Accordingly, the thickness of material 220 is set to be large enough as shown in FIG. 11 and its width W is set to be equal to or somewhat smaller than the distance between walls 16 rising in the radial direction from the respective outer side ends of flat surfaces 15 of roll 11. The width W of material 220 is rolled to be plastically deformed by the pressure of roll 11. However, the material 220 is restrained in the width direction by walls 16 and the escape on both sides is regulated with the reduction of clearance between the die and roll. The deformation of the material causes the material to flow out between the walls 6 and 16 to shape ear parts. The material, regulated and restrained in the width direction, must move toward the inside diameter. Because the concave groove 17 for shaping the projection is provided in this inside diameter part on the roll, the material flowing toward the inside diameter flows into groove 17 to plastically shape projection 27. Because the material 220 is thus rolled and shaped while being regulated and restrained in the width direction by recess 14 of roll 11, even if the deformation toward the diameter enlarging direction is high, projection 27, which is substantially thicker in the radial direction than the thickness of the material 220, will be able to be shaped in the inner periphery of the material.

Thus, according to the present invention, rim 21 having projection 27 in the inner periphery as shown in FIG. 6 can be shaped by one step while maintaining the outside diameter dimension, cross-sectional shape and circularity at such high precision that no subsequent correcting step is required.

Figure 12:
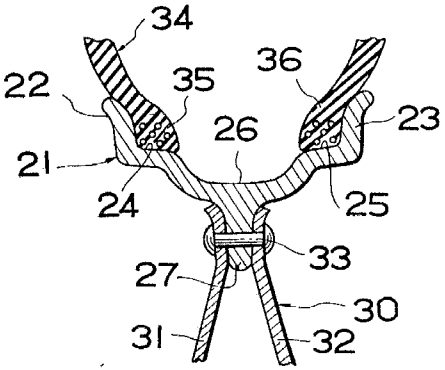
FIG. 12 is an enlarged sectional view of a rim part of a wheel utilizing the rim according to the invention.

FIG. 12 is an enlarged vertically sectioned view of a rim part of a wheel 30 employing a rim formed in accordance with the present invention.

In the embodiment of FIG. 12, plates 31 and 32, connected in their base ends to a hub (not shown) are fastened together at the tip ends thereof through both side surfaces of projection 27 by rivets 33 passing through plates 31 and 32 and projection 27. Beads 35 and 36 of a tire 34 are supported on the side surfaces thereof inside the ear pieces 22 and 23 and at the lower ends by the receiving parts 24 and 25 of rim 21. Thus, the dropping part 26 of rim 21 requires no fitting holes, so as to ensure high air-tightness for a tubeless tire.

Figure 14:
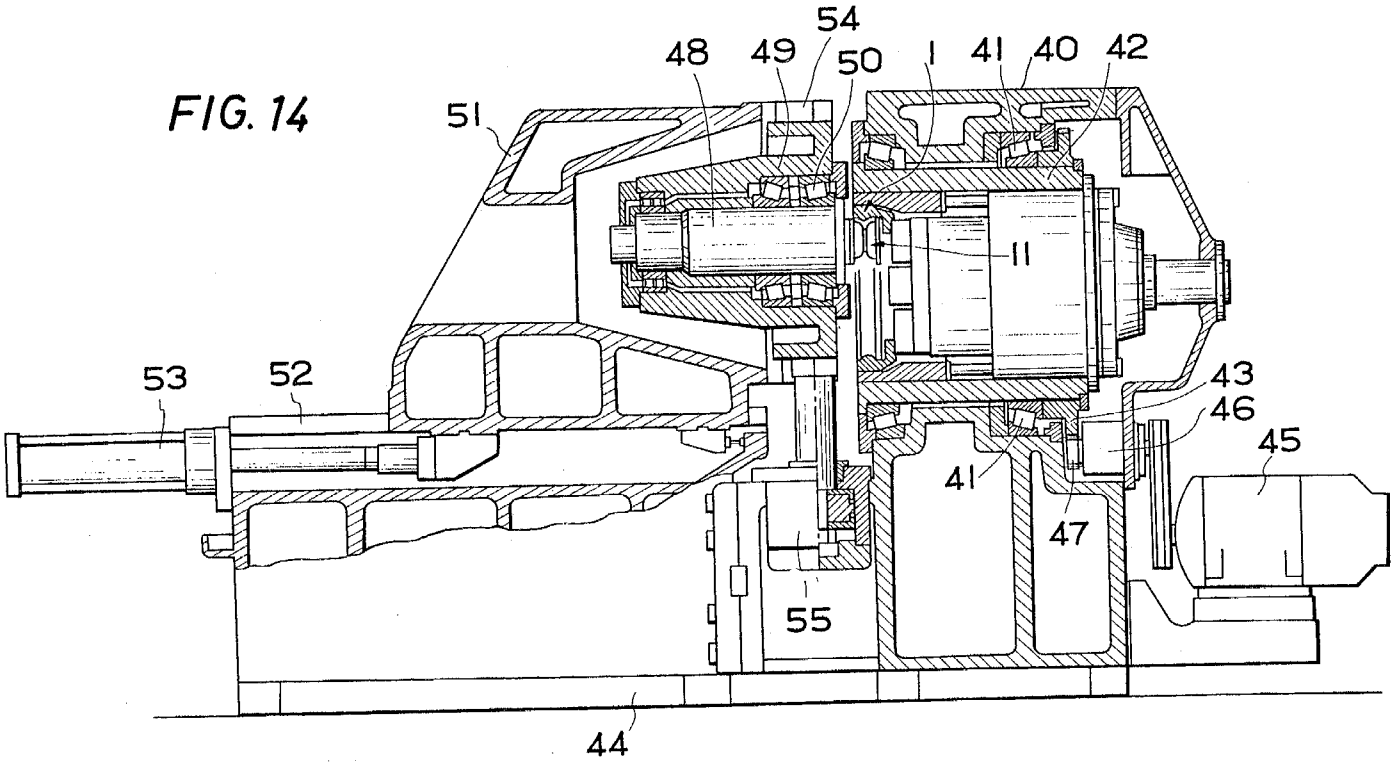
FIG. 14 is a view showing an example of a shaping apparatus, sectioned in the important parts.

FIG. 14 depicts an embodiment of a shaping machine to be employed for the above described shaping operation.

The die 1 comprises a plurality of segmental dies adapted to expand outwardly in the radial direction so as to make it possible to take out the shaped product after shaping. The die 1 is supported within a drum-shaped die spindle 42 rotatably supported through bearings 41 in a die head 40. The spindle 42 is driven by the meshing of a gear 43 provided on the outer periphery of the rear end of the spindle with a pinion 47 driven by a motor 45, fixed on a frame 44, through a reduction gear 46.

The pressing roll 11 is supported at an end by a roll spindle 48 which is rotatably supported through bearings 50 in a spindle case 49 slidable forwardly and rearwardly by a cylinder unit 53 on a bed 52, together with a slider 51. The spindle case 49 is made free to make vertical movements along grooves 54 provided in the front part of the slider 51 by a pressure cylinder unit 55, so as to make possible a radially pressing movement of the roll.

One example of the apparatus has been illustrated and described, but the apparatus is not limited to such structure and other types of mechanisms may be adopted.

I claim:

1. A method for manufacturing seamless wheel rims, including the steps of:

interposing a ring-shaped initial material between a rotatable die having an inner surface corresponding to an outside diameter dimension and an outer peripheral shape of a rim to be formed and a freely rotatable pressing roll provided within said die and having an outer surface corresponding to an inner peripheral shape of said rim;

said ring-shaped material having a diameter larger than the outside diameter of said roll and smaller than the inside diameter of said die;

driving said die to rotate;

moving said roll toward said die;

roll-shaping said material interposed between said die and said pressing roll by the pressing action of said roll while said material is rotated by said die and enlarged in diameter;

further roll-shaping said enlarged material while the enlarging deformation of said material is regulated by said die so as to cause substantial metal flow of said enlarged material between said die and said roll;

forming both side ends of the shaped material while excess material portions are formed to protrude sidewardly from reduced clearances defined for throttling the metal flow between said die and said roll on both sides in the width direction; and forming a projection on the inner periphery of said enlarged material, the thickness of said projection in the radial direction being substantially thicker than that of said initial material, while the metal flow in the width direction of said enlarged material is restrained by said reduced clearances.

2. A method according to claim 1, further including the steps of:

setting the volume of said initial material to be higher than the volume of said rim to be formed; and removing said excess material portions on both sides in the width direction of the shaped blank to obtain a completed rim.

3. A method according to claim 1, wherein:

said projection is formed in the center in the width direction of the inner periphery of said material by a ring-shaped concave groove provided in a part formed on the outer periphery of said pressing roll, said groove submerging inwardly in the radial direction.

4. A method according to claim 3, wherein:

said part of said pressing roll comprises a recess;

said initial material is set to have a width substantially equal to the width of said recess; and said material is extruded into said concave groove to shape said projection on the inner periphery of said material.

* * * * *